United States Patent [19]

Spinosa et al.

[11] Patent Number: 4,619,255

[45] Date of Patent: Oct. 28, 1986

[54] OXYGEN SUPPLY SYSTEM

[75] Inventors: Dominic J. Spinosa, Wantagh; Frank Knoll, Huntington Station, both of N.Y.

[73] Assignee: East/West Industries, Inc., Hauppauge, N.Y.

[21] Appl. No.: 632,381

[22] Filed: Jul. 19, 1984

Related U.S. Application Data

[63] Continuation-in-part of Ser. No. 321,420, Nov. 16, 1981, abandoned.

[51] Int. Cl.[4] ..... A62B 7/00

[52] U.S. Cl. ..... 128/202.27; 128/205.24; 137/113; 244/122 A

[58] Field of Search ..... 128/202.27, 204.29, 128/201.28, 205.24, 202.11, 204.26; 137/112, 113; 251/149.6; 244/122 R, 122 A, 122 AE, 122 AH

[56] References Cited

U.S. PATENT DOCUMENTS

| | | | |
|---|---|---|---|
| 2,300,694 | 11/1942 | Overbeke | 137/113 |
| 2,408,799 | 10/1946 | Melichar | 137/113 |
| 2,569,967 | 10/1951 | Ashton | 137/113 |
| 4,362,089 | 12/1982 | Melocik et al. | 137/113 |

*Primary Examiner*—Henry J. Recla

*Attorney, Agent, or Firm*—Hoffmann, Dilworth, Barrese & Baron

[57] ABSTRACT

An emergency oxygen system for use on aircraft in conjunction with an on-board primary oxygen supply system is designed to supply oxygen to aircraft personnel in the event that the on-board oxygen supply system fails. Additionally, if the aircraft personnel is forced to eject from the aircraft, the emergency oxygen system automatically activates to provide oxygen and simultaneously disengages all electrical connections from the aircraft frame. The system includes an emergency oxygen supply which is coupled to a differential pressure activated valve through an oxygen release valve, the oxygen release valve having the capability of being manually or automatically triggered. The on-board oxygen supply system is also coupled to the differential pressure activated valve and, depending upon the relative pressure between the on-board oxygen supply system and the emergency supply system, as sensed by the differential pressure activated valve, oxygen from one or the other is channeled from the differential pressure activated valve to a face mask or the like.

26 Claims, 15 Drawing Figures

OXYGEN SUPPLY SYSTEM

The present application is a continuation-in-part of application Ser. No. 321,420 filed Nov. 16, 1981 presently abandoned.

BACKGROUND OF THE INVENTION

1. Field of the Invention

The present invention is directed generally toward oxygen supply systems for use on aircraft, and more particularly to an emergency oxygen system for use in conjunction with a primary oxygen supply system wherein the emergency oxygen system is activated either manually or by aircraft personnel as a result of failure of the primary oxygen supply system or upon ejection of aircraft personnel from an aircraft wherein all electrical connections to the aircraft are disengaged simultaneously with the activation of the emergency oxygen system.

2. Description of the Prior Art

When certain aircraft fly at high altitudes, it is necessary or desirable to provide the aircraft personnel aboard the aircraft with a supply of oxygen delivered through a face mask. Aircraft presently employ liquid oxygen systems (LOX) or On Board Oxygen Generating Systems (OBOGS) to supply oxygen to aircraft personnel. The LOX system converts liquid oxygen to gaseous oxygen at a reduced pressure so that it can be consumed by aircraft personnel. OBOGS operates on a molecular sieve adsorption principle and concentrates oxygen from a conditioned engine bleed air.

Whether a LOX system or OBOGS is employed, there are certain instances when it is necessary to provide a backup oxygen system. One obvious instance is in the event that either above described system should fail necessitating an emergency source of oxygen supply. Additionally, aircraft which fly at altitudes that necessitate provision of oxygen to aircraft personnel are frequently military aircraft and also include personnel ejection mechanisms. When aircraft personnel are ejected from a flying aircraft, it is necessary to provide sufficient breathing oxygen until the aircraft personnel, during descent, reach a point in the atmosphere where there is sufficient oxygen for breathing. Although in either circumstance it is possible to remove the oxygen mask which is worn and hooked to an onboard oxygen supply system, this is extremely inconvenient, generally dangerous, and undesirable because of the length of time it takes and the resultant inattentiveness to other procedures of the aircraft personnel who must switch masks. Therefore, it is not particularly feasible to provide a supplementary oxygen system which necessitates the changing of face masks.

The present invention provides an emergency oxygen system which is mounted to the seat of the user and which integrates itself into the on board oxygen supply system and the conventional oxygen mask worn by aircraft personnel. Without necessitation of changing face masks or switching connectors from one system to another, the present invention permits the user to quickly release breathing oxygen in the event of primary on board oxygen system failure and also provides for automatic activation of a supplementary emergency oxygen system in the event of ejection of the user.

Various types of connectors have been proposed in the prior art including that shown in U.S. Pat. No. 3,082,394 issued to R. H. Hahn on Mar. 19, 1963. The present invention employs quick release connectors so that connections to the system can be easily, quickly, and positively made. Additionally, in contrast to many prior art systems, the electrical connections which must be made from the face mask to on board electronic instruments such as for earphones and microphones, and related apparatus are integrated into the system such that oxygen connection and electrical connection are in some instances made simultaneously, but in all instances very conveniently.

OBJECTS OF THE INVENTION

Therefore, a primary object of the present invention is to provide an emergency oxygen system for use on aircraft.

A further object of the present invention is to provide an emergency oxygen system which can be integrated with presently known primary oxygen deliveries or supply systems and conventional oxygen masks.

Still another object of the present invention is to provide an emergency oxygen system which can be quickly activated without the necessity of interchanging of connections.

Still another further object of the present invention is to provide an emergency oxygen and electrical disconnect system which is automatically activated upon ejection of the user from an aircraft.

A still further and additional object of the present invention is to provide an emergency oxygen system which incorporates means for electrically cabling and disconnecting electronic components associated with an oxygen mask to electronic instrumentation or systems mounted in the aircraft.

An additional object of the present invention is to provide an emergency oxygen system which can be used either with OBOGS or LOX systems without modification.

A still further additional object of the present invention is to provide an emergency oxygen system which can be readily retrofitted to existing aircraft.

Still another additional and further object of the present invention is to provide an emergency oxygen system which can be readily serviced.

A still additional object of the present invention is to provide an emergency oxygen system which is simple in design, efficient in operation, rugged in construction, and durable.

Other objects and advantages of the present invention will become apparent as the disclosure proceeds.

SUMMARY OF THE INVENTION

An emergency oxygen system for use in aircraft in conjucntion with a primary oxygen supply system which supplies oxygen to aircraft personnel through an oxygen mask or the like is provided. The system includes an emergency oxygen supply, characteristically a cylinder of oxygen, the oxygen from the cylinder being delivered upon opening of an oxygen release valve in communication with the oxygen cylinder. The oxygen release valve can be manually opened by pulling of a ring or is automatically opened by pulling of a cable upon ejection of the aircraft personnel using the emergency oxygen system. The system is compactly mounted under the seat of the user for ready access.

The oxygen release valve is coupled to a differential pressure activated valve. The differential pressure activated valve includes a pair of inputs and an output, one of the inputs being in communication with a LOX or OBOGS system which serves as the primary oxygen supply. The other input is connected to the oxygen release valve so that it can be put in communication with the oxygen cylinder upon opening of the oxygen release valve. The output of the differential pressure activated valve is in communication with an oxygen mask. The differential pressure activated valve which is generally in a manifold configuration, includes a valve shuttle which, in its first position, causes the input of the differential pressure activated valve which is in communication with the primary supply of oxygen, to be in communication with the oxygen mask.

Upon the opening of the oxygen release valve, the pressure from the oxygen cylinder, reduced by a reducer, is greater than the pressure at which the primary oxygen supply system operates therefore causing the valve shuttle to shift from its first position to a second position sealing the primary oxygen supply from the face mask and connecting the emergency oxygen supply to the oxygen mask.

The primary oxygen supply is connected to the differential pressure activated valve by a hose assembly which includes a quick release connection the elements of which can be locked together. The quick connection includes a valve which seals off the portion of the hose connected to the on board primary oxygen supply system so that when the connection is broken the on board supply system is sealed. The output of the differential pressure activated valve is connected to the oxygen mask by another hose assembly also incorporating a quick release connector. This quick release connection also incorporates a valve such that when the connection is disengaged the portion of the hose connected to the output of the differential pressure activated valve is sealed. When the connection is made, this valve is opened.

Provision for integrating the electrical cable which runs from a typical oxygen mask to on board electronic systems, such as for a microphone and a headphone and related apparatus, is neatly integrated into the hose assemblies through the use of clamps and an electrical connector which works concurrently with the quick release connection disposed in the hose assembly which connects the differential pressure activated valve to the oxygen mask. The present invention readily conforms in design to applicable military standards.

BRIEF DESCRIPTION OF THE DRAWINGS

Although the characteristic features of this invention will particularly be pointed out in the claims, the invention itself and the manner in which it may be made and used may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
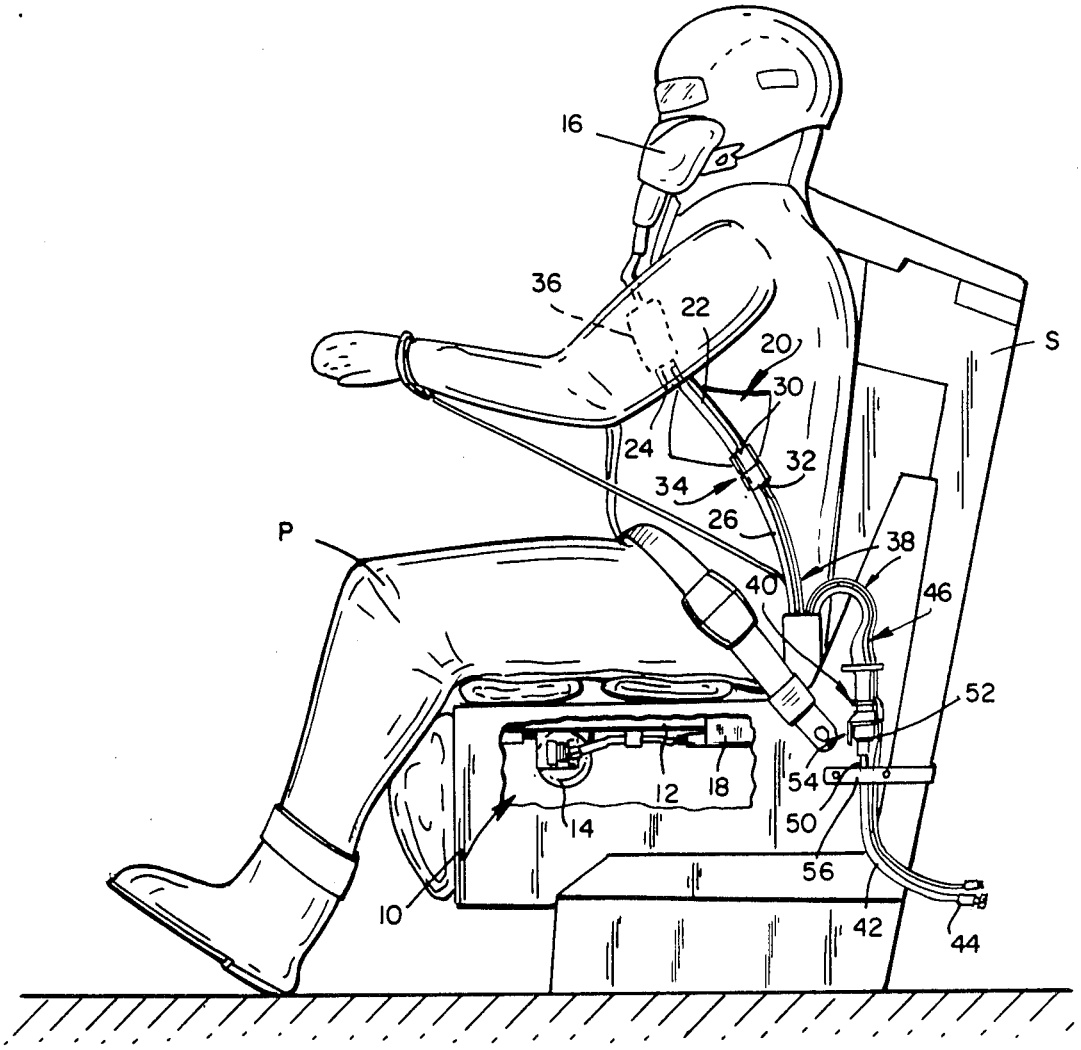
FIG. 1 is a pictorial representation of an emergency oxygen system, incorporating the principles of the present invention, in use by an airplane pilot.

Referring now to the drawings, and initially to FIG. 1 thereof, there is illustrated therein an emergency oxygen system 10 which incorporates the principles of the present invention. The emergency oxygen system 10 is shown in use by a pilot P seated in an ejection seat S of an aircraft, not illustrated. Inside the seat S is mounted a platform 12 which serves to mount several of the components of the present invention including an oxygen supply cylinder 14, these components being hereinafter described in conjunction with FIGS. 2 and 3.

Oxygen is delivered to the pilot P through an oxygen mask 16. The mask 16 is connected to a differential pressure activated valve 18 by an oxygen delivery hose assembly 20. The oxygen delivery hose assembly 20 includes a first section 22 fixedly secured and operably engaged on an end 24 thereof to the oxygen mask 16 and a second section 26 operably connected on an end 28 thereof, as further illustrated in FIG. 2, to the differential pressure activated valve 18. The first and second sections 22 and 26 have their ends, respectively, 30 and 32 coupled together by a quick release mechanism 34. Disposed in the first section 22 of the oxygen delivery hose 20 is a pressure regulator 36 which is of a conventional design and is provided to regulate the pressure delivered to the oxygen mask 16. The oxygen mask 16 includes electrical devices such as earphones or microphones, not illustrated, which couple to related electrical devices stored on the aircraft, these electrical devices being coupled together by electrical cabling 38, hereinafter described in detail in conjunction with FIG. 2.

Figure 2:
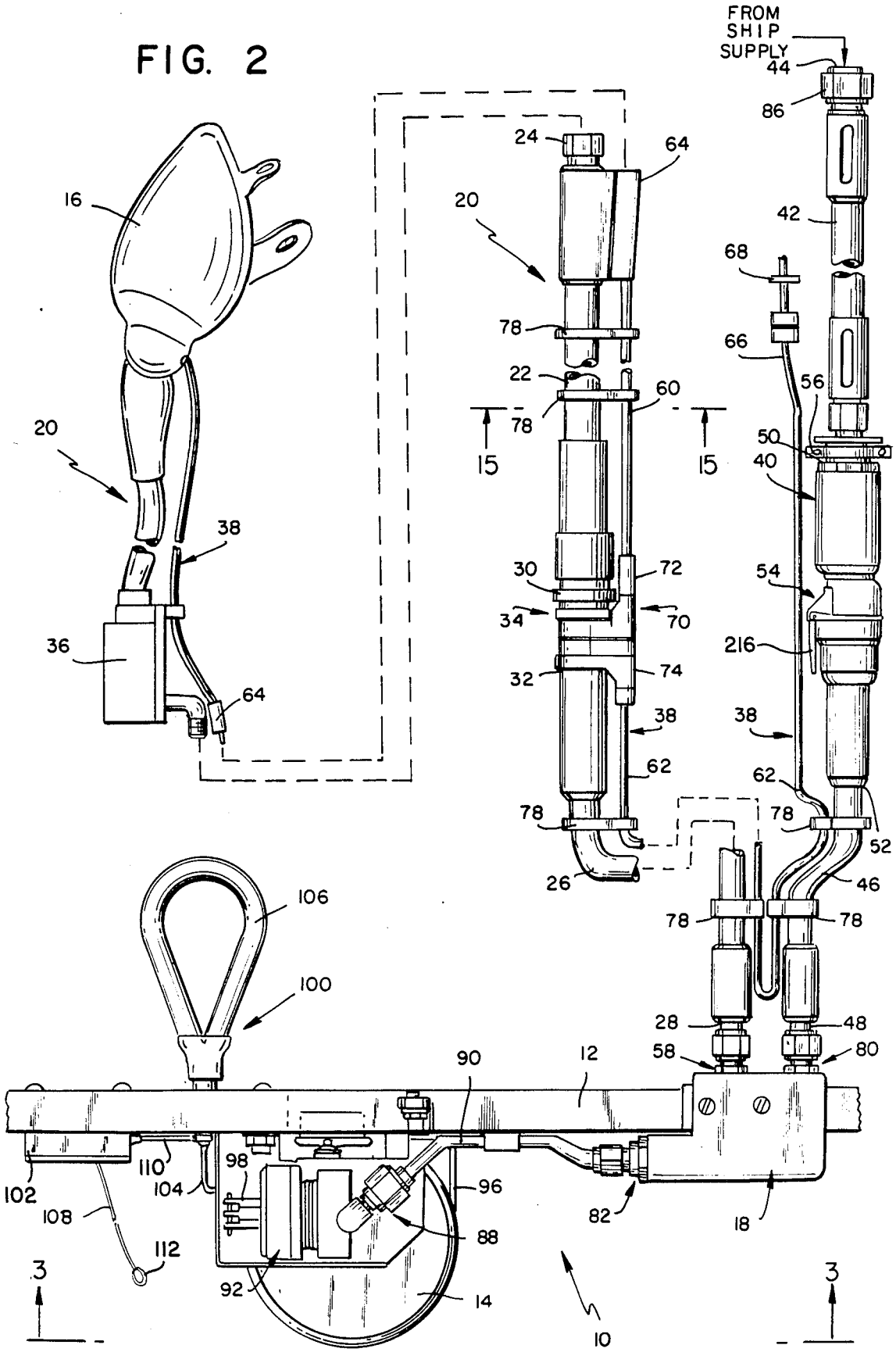
FIG. 2 is an assembled view of the components of the present invention.

The differential pressure activated valve 18 is coupled to an on board oxygen supply system, not illustrated, by an oxygen supply hose assembly 40 as further illustrated in FIG. 2. The oxygen supply hose assembly 40 includes a first section 42 adapted to be affixed on an end 44 thereof to the on board oxygen supply system. A second section 46 of the oxygen supply hose assembly 40 is coupled on an end 48 thereof to the differential pressure activated valve 18. The ends 50 and 52, respectively, of the first section 42 and the second section 46 are joined together by a breakaway release coupling mechanism 54 affixed to the first section 42 is secured in position to the seat S by a bracket 56.

The illustration of FIG. 1 shows one manner in which the emergency oxygen system 10 of the present invention can be installed on an aircraft and the configuration illustrated is not meant to limit installation of the system 10 to this particular configuration, other configurations being possible within the scope of the present invention.

Figure 3:
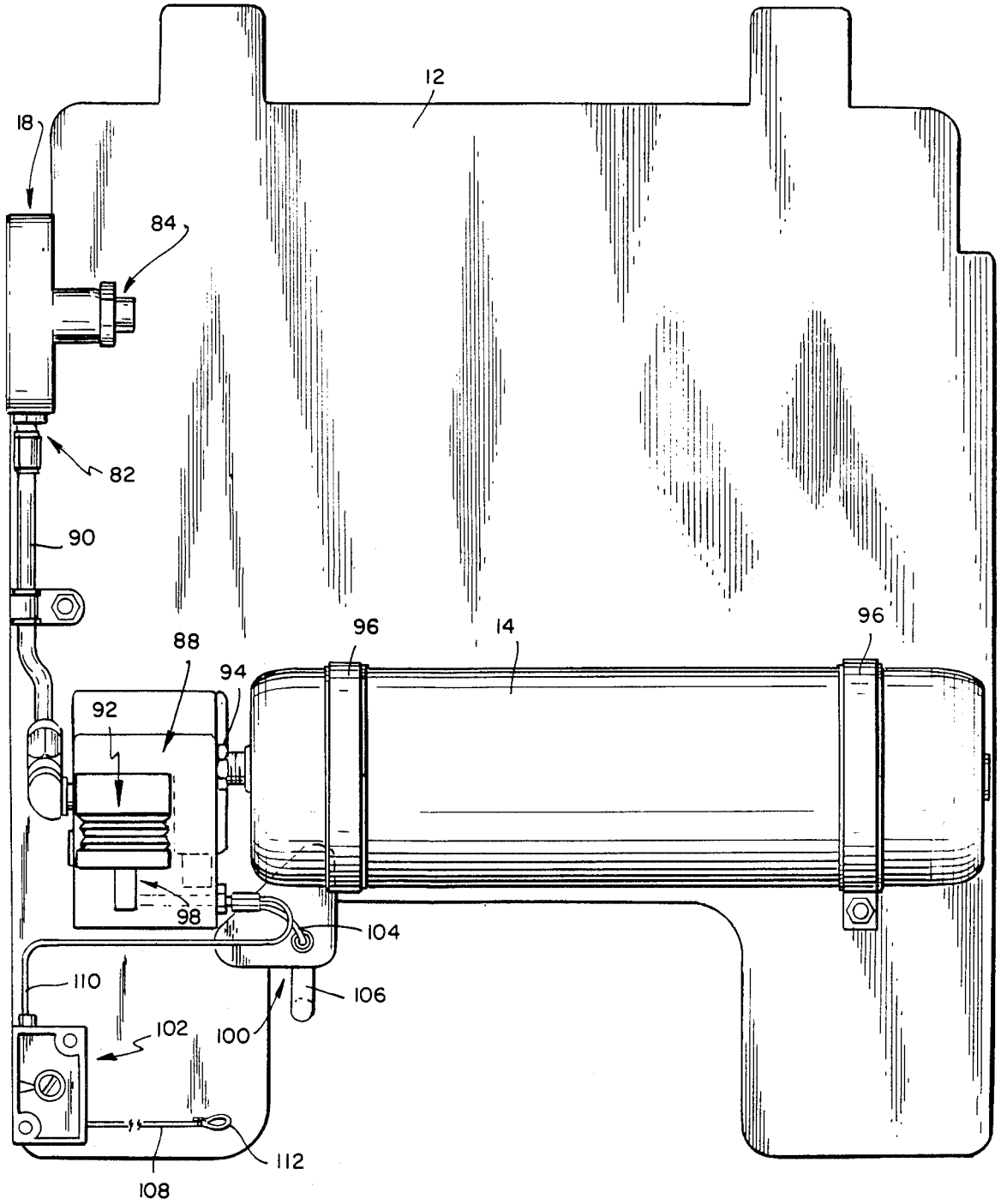
FIG. 3 is a bottom view of the platform onto which the components of the present invention are mounted taken from the lines 3—3 of FIG. 2.

With reference to FIGS. 2 and 3, the detailed assembly of the present invention can be described. The oxygen mask 16 has connecting thereto a portion of the first section 22 of the oxygen delivery hose assembly 20 putting the same in communication with the oxygen pressure regulator 36. The oxygen pressure regulator 36 is connected to the other portion of the first section 22 of the oxygen delivery hose assembly and is in communication with the quick release coupling mechanism 34.

The second section 26 of the oxygen delivery hose assembly 20 is coupled to the differential pressure activated valve 18, at the output 58 thereof, thus putting the output 58 in communication with the oxygen chamber of the mask 16. As previously mentioned, the mask 16 includes electrical apparatuses or devices such as microphones, earphones, or the like which are connected by electrical cabling 38 to other electrical devices mounted on the aircraft in which the emergency oxygen supply system 10 is incorporated.

The electrical cabling 38 comprises cabling and connectors which includes a first segment 60 and a second segment 62. The end 64 of the first segment 60 of the electrical cabling 38 is operably connected to electrical devices in the oxygen mask 16. The end 66 of the second segment 62 of the electrical cable or electrical cabling 38 terminates in an electrical connector 68 suitably configured to hook to the electrical devices disposed on the aircraft. The first and second segments 60 and 62 of the electrical cabling 38 are joined together by an electrical connector assembly 70 comprising mating electrical connectors 72 and 74. The electrical connectors 72 and 74 are integrally formed with the quick release coupling mechanism 34 as further illustrated in FIGS. 6, 7, 8, 9, and 10. The first segment 60 of the cabling 38 is fixedly secured to the oxygen supply hose assembly 40 at a variety of locations by a plurality of straps 76. The straps 76 can be variously configured and are provided to keep the first segment 60 of the electrical cabling 38 proximate to the oxygen delivery hose assembly 20. The second segment 62 of the electrical cabling 38 is mounted, by a plurality of straps 78, to both the oxygen delivery hose assembly 20 and the oxygen supply hose assembly 40 to keep the segment 62 of the electrical cabling 38 proximate to the hose assemblies 20 and 40. The straps 76 and 78 are resilient to permit removal of the electrical cabling 38 from the hose assemblies 20 and 40 for maintenance or replacement. In the manner the communication system is readily removable.

When the quick release coupling mechanism 34 is separated the electrical connectors 72 and 74 also separate, permitting the pilot P to simultaneously disengage both the oxygen and the electrical connections. The relationship between the quick release coupling mechanism 34 and the electrical connector assembly 70 is further disclosed in conjunction with FIGS. 6 through 10.

Figure 4:
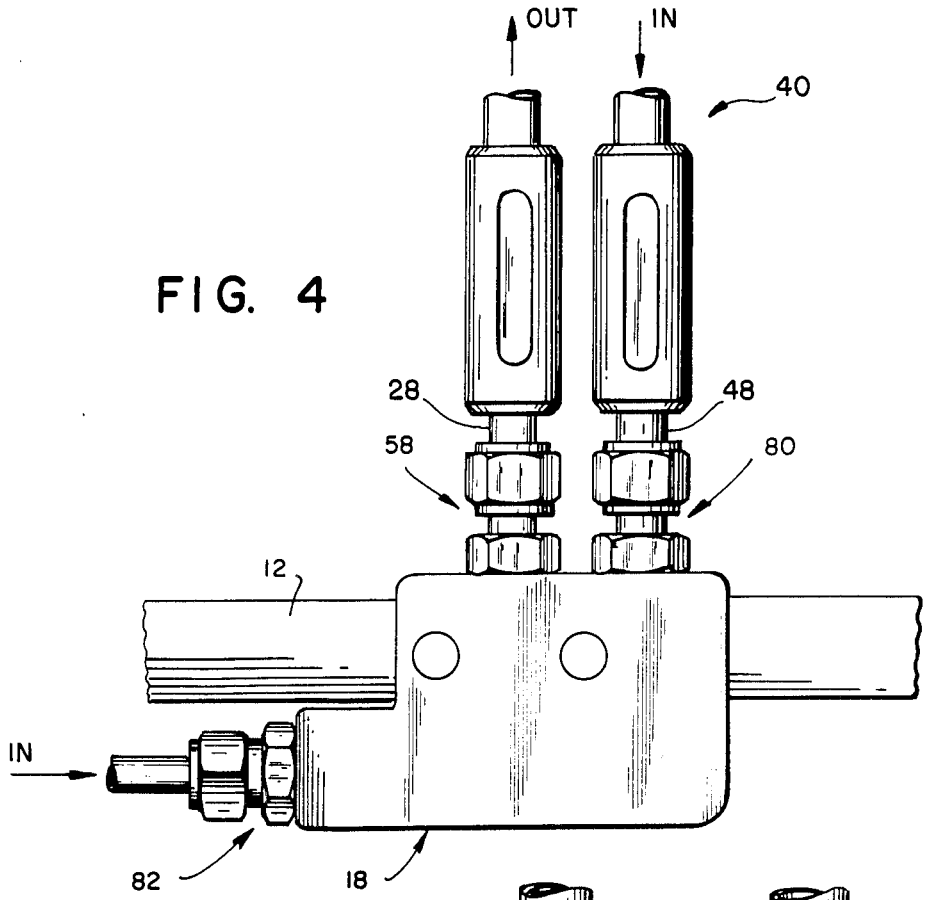
FIG. 4 is a plan view of the differential pressure activated valve of the present invention.
Figure 5:
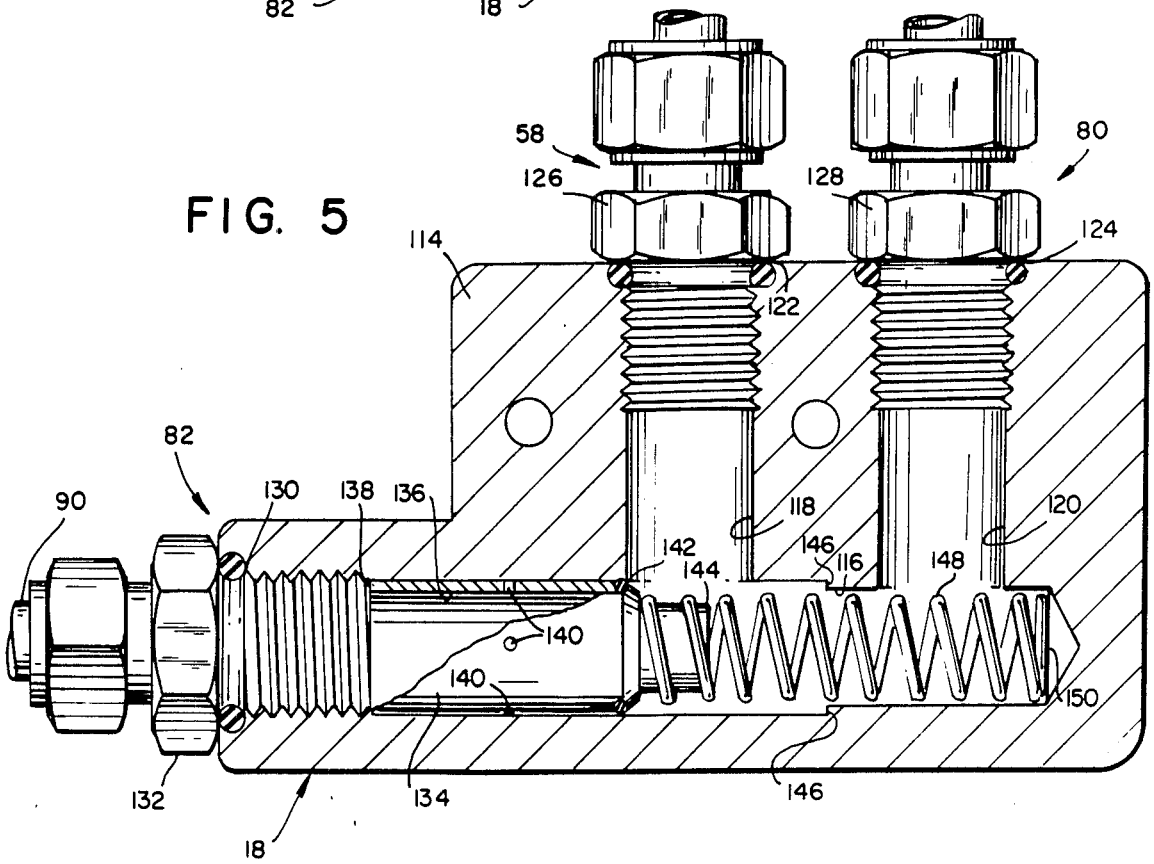
FIG. 5 is a partially broken away enlarged view of the differential pressure activated valve of the present invention.

The differential pressure activated valve 18, further illustrated in FIGS. 4 and 5, includes a pair of inputs 80 and 82 which are selectively coupled by the differential pressure activated valve 18 to the output 58 thereof. In addition, the differential pressure activated valve 18 includes a pressure relief 84 of conventional design which is self-activated upon a build up of pressure inside the differential pressure activated valve in excess of predetermined operating limits. The on board primary supply of the oxygen, not illustrated, is coupled to the input 80 (FIG. 2) by the oxygen supply hose 40, by a connector 86 disposed at the end 44 thereof for hooking to the primary oxygen supply. The primary oxygen supply may comprise a liquid oxygen system (LOX), an On Board Oxygen Generating System (OBOGS), such as that commercially marketed by the Bendix Corporation, or other suitable supply means well known in the art. The second section 46 of the oxygen supply hose assembly 40 is affixed on the end 48 thereof to the input 80 of the differential pressure activated valve 18. The end 28 of second section 26 is affixed to the output 58 of the valve 18. The end 48 of the second section 46 of the oxygen supply hose assembly as well as the end 28 of the second section 26 of the oxygen hose assembly 20 are affixed to the differential pressure activated valve 18 by conventional connectors as illustrated. Disposed between the first and second sections 42 and 46 of the oxygen supply hose assembly 40 is the breakaway release coupling mechanism 54, the details of which are discussed in conjunction with FIGS. 11, 12, and 13.

The input 82 of the differential pressure activated valve 18 is coupled to a pressure reducer 88 by a conduit 90. The pressure reducer 88 in turn is coupled to an oxygen release valve 92, the input 94 thereof being in communication with the oxygen cylinder 14. The oxygen release valve 92 and the pressure reducer 88 are mounted to the platform 12 in a suitable manner, the oxygen cylinder 14 being fixedly secured thereto by a pair of straps 96. The oxygen cylinder is at a relatively high pressure, for instance, 1800 to 2100 psi, the pressure reducer 88 lowering this pressure to a range, for instance, of pressure less than 45 to 80 psi such that it is suitable for a supply of oxygen to the regulator 36. The oxygen release valve 92 includes a trigger 98, the displacement of which opens the oxygen release valve 92 and permits flow of oxygen from the cylinder 14 through the pressure reducer 88 to the input 82 of the differential pressure activated valve 18.

Displacement of the trigger 98 of the oxygen release valve 92 can be accomplished by either use of a manual oxygen release handle device 100 or an automatic oxygen release mechanism 102. The manual oxygen release 100 includes a cable 104 terminating in a pull ring 106. When the pull ring 106 is pulled by the user, the trigger 98 is displaced opening the oxygen release valve 92. The pull ring 106 is dimensioned for grasping by the pilot P and is accessibly mounted adjacent to the seat S. The restraint on the cable 104 is such that urging of the pull ring and tripping of the oxygen release valve 92 requires approximately 20 pounds of force. Alternatively the oxygen release valve 92 can be opened by the automatic oxygen release 102 through the pulling of the cord 108 thereof.

The automatic oxygen release 102 includes a cam assembly, not illustrated, which translates motion of the cord 108 to a pulling force and a cable 110 which couples the automatic oxygen release 102 to the trigger 98 of the oxygen release valve 92. The cord 108 acts as a tether and the end 112 thereof is fixedly secured to a suitable structure within the aircraft. Since the seat S is of the ejection type, when the pilot is ejected, the cord 108 is pulled as a result of relative movement between the platform 12, to which the automatic oxygen release 102 is mounted, and the aircraft. As a result, oxygen from the oxygen cylinder 14 is supplied to the input 82 of the differential pressure activated valve 18 and therefore to the oxygen mask 16 as hereinafter described.

It should be apparent that the differential pressure activated valve 18 provides a critical function in relation to the oxygen supply cylinder 14, the on board oxygen system of the aircraft, and the desired supply of oxygen to the face mask 16. This relationship will now be further described in conjunction with FIGS. 4 and 5. Functionally, the differential pressure activated valve 18 includes the inputs 80 and 82 and the output 58. The input 80 is in communication with the primary on board oxygen supply and the input 82 is in communication with the output of the oxygen release valve 92 which in turn is in communication with the oxygen cylinder 14 and the pressure reducer 88. The output 58 of the differential pressure activated valve 18 is in communication with the oxygen mask 16 through the pressure regulator 36.

The differential pressure activated valve 18, when at rest, puts the input 80 thereof and therefore the on board primary oxygen supply in communication with the output 58 thereof and therefore the oxygen mask 16. Upon sensing of sufficient pressure at the input 82 with loss of pressure at input 80, the differential pressure activated valve 18 puts the output 58 thereof in communication with the input 82 thereof isolating (sealing) therefrom the input 80. This activation is a direct result of a shift in the pressure differential between the inputs 80 and 82 of the differential pressure activating valve 18.

The differential pressure activated valve 18 includes a housing 114 which forms therein an elongated chamber 116. The housing 114 also forms therein a pair of ports 118 and 120, the ports 118 and 120 being spaced apart and in communication with the elongated chamber 116. The ends 122 and 124 respectively of the ports 118 and 120 open through the housing 114 and are engaged by conventional fittings, respectively, 126 and 128 to, respectively, the oxygen delivery hose assembly 20 and the oxygen supply hose assembly 40. An end 130 of the elongated chamber 116 also opens through the housing 114 and forms the input 82. The conduit 90 is in communication with the chamber 114, the conduit 90 being connected to the housing 114 at the input 82 by a conventional coupling 132.

A valve shuttle 134 is disposed within the elongated chamber 116 and is dimensioned so that it can freely reciprocate within the chamber 116. The valve shuttle 134 forms a passage 136 therein which opens through the end 138 thereof. The end 138 of the valve shuttle 134 is disposed adjacent to the end 130 of the chamber 116 formed by the housing 114. A plurality of apertures 140 are disposed through the walls of the valve shuttle 134 and are in communication with the chamber 136 formed thereby.

The valve shuttle 134 has an O-ring 142 mounted thereon, adjacent to the tapered head portion 144 of the valve shuttle 134, the O-ring 142 forming a valve poppet for engagement by an annular ridge 146 formed in the elongated chamber 116. When the valve shuttle 134 is in a rest position, as illustrated in FIG. 5, the O-ring 142 prevents passage of fluid around the shuttle 134 thereby effectively sealing the input 82 from the output 58 and input 80. The input 80 and the output 58 are therefore in communication through the elongated chamber 116 when the valve shuttle is in a rest position. The valve shuttle 134 is maintained in the rest position by a helical compression spring 148 which engages on one end thereof the blind end 150 of the elongated chamber 116 and on the other end thereof the head 144 of the valve shuttle 134. Oxygen entering the input 80 tends to aid the helical compression spring 148 to maintain the valve shuttle 134 in position.

When oxygen is supplied to the input 90 as a result of the opening of the oxygen release valve 92 through the manipulation of the manual oxygen release 100 or the automatic oxygen release 102, the pressure formed at the end 130 of the elongated chamber 116 and in the passage 136 of the valve shuttle 134 forces the valve shuttle to shift compressing the helical compression spring 148. The valve shuttle 134 shifts in the elongated chamber 116 toward the blind end 150 thereof until the O-ring 142 engages the annular ridge 146. The engagement of the O-ring 142 and the annular ridge 146 seals off the portion of the elongated chamber 116 adjacent to the blind end 150 thereof and denies communication between the input 80 of the differential pressure activated valve 18 and the output 58 thereof. At the same time, shifting of the valve shuttle 134 places the plurality of apertures 140 in communication with the port 118 formed in the housing 114 thereby putting the input 90 of the differential pressure activated valve 118 in communication with the output thereof. The input 90 and the output 58 remain in communication as long as a sufficient pressure head is provided at input 90 which will cause the valve shuttle 134 to shift. Obviously, the spring constant of the helical compression spring 148 can be matched to the relative pressures supplied at the inputs 80 or 90, respectively, by the primary oxygen supply system and the emergency oxygen supply cylinder 14. Typically, a LOX system will provide a pressure of between 40 to 80 psi and an OBOGS a pressure of 5 to 35 psi. The spring constant of the spring 148 is such that a greater pressure at input 90, as a result of failure of the primary oxygen system or as a result of wishing to override the primary oxygen system, causes shifting of the valve shuttle 134.

Although the helical compression spring 148 is illustrated as urging the valve shuttle 134 into its rest position, it is to be understood that other suitable biasing means can be alternatively employed. Additionally, the rest position for the valve shuttle 134 could be reversed with its displaced position by reversing the direction of the force of the biasing means if the ensuing operational characteristics are desired.

Figure 6:
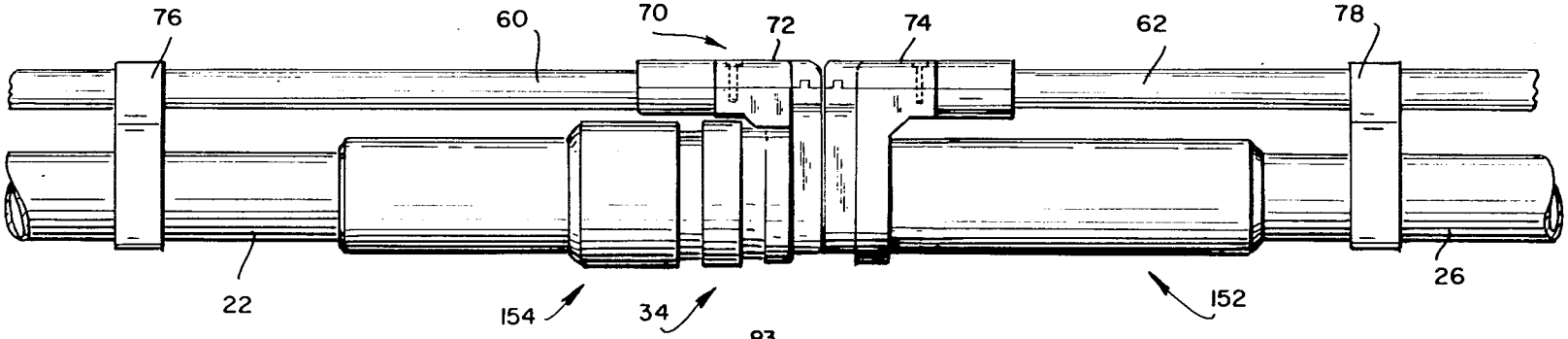
FIG. 6 is an assembled view of the quick release connection of the present invention which incorporates a pair of mating electrical connectors.
Figure 7:
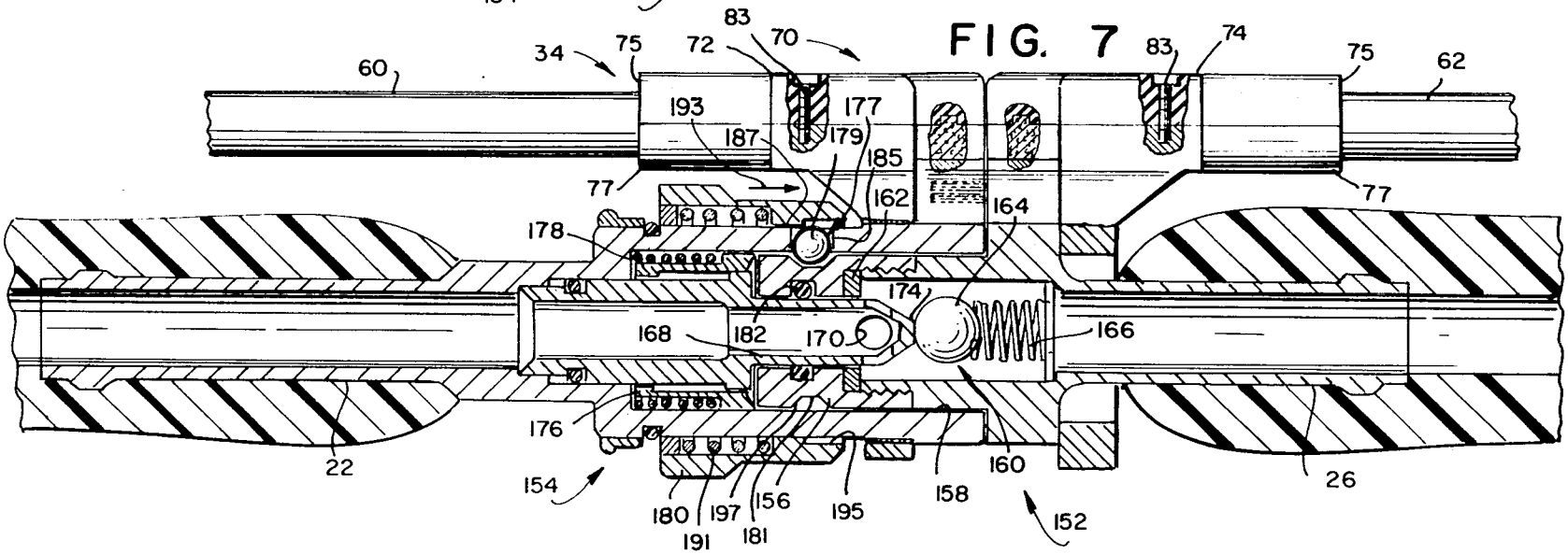
FIG. 7 is an enlarged cross sectional view of the quick release connection of FIG. 6.
Figures 8, 9, 10, 15:
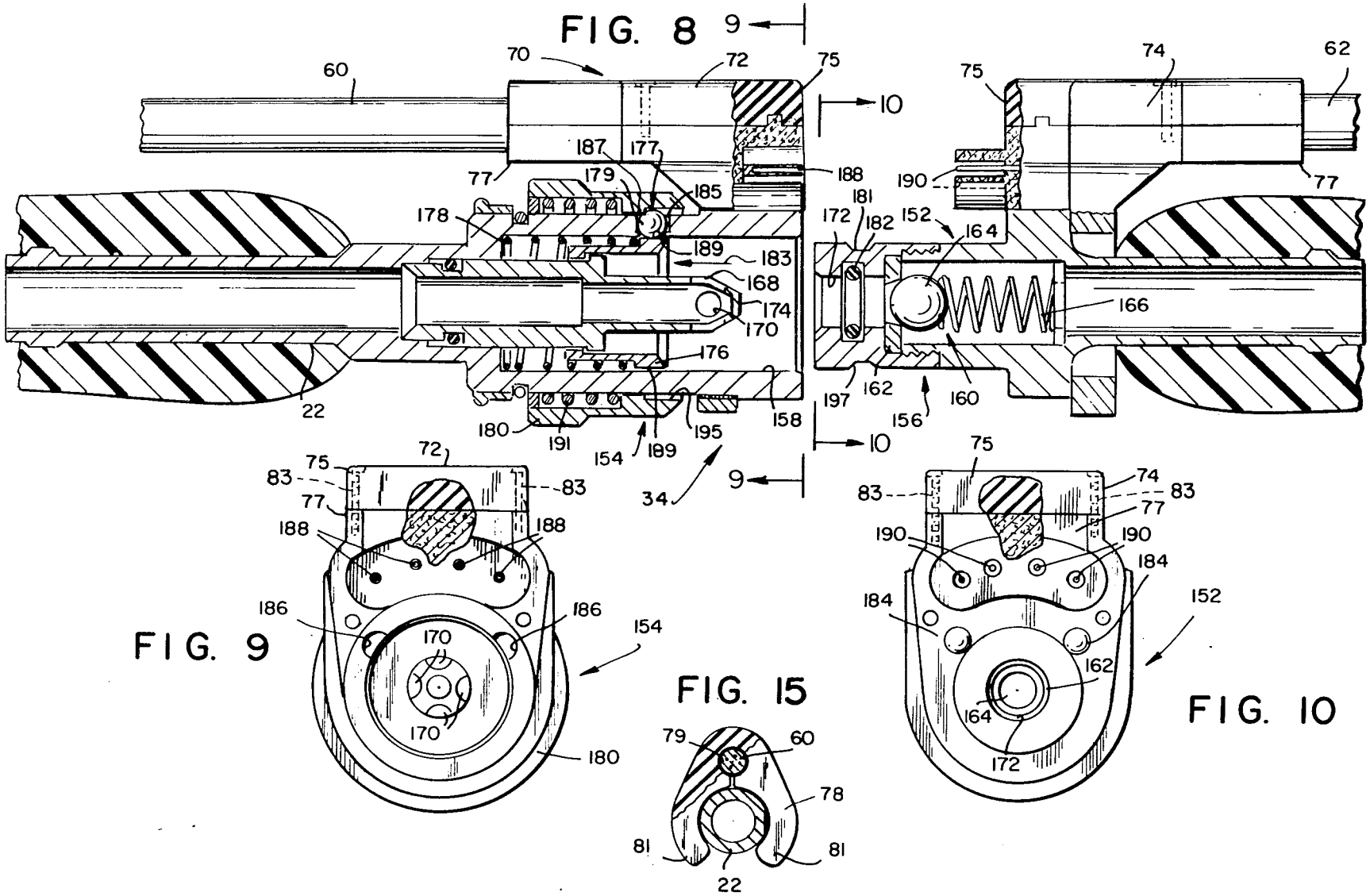
FIG. 8 is an enlarged cross sectional view of the connectors of FIG. 7 in a disengaged condition.
FIG. 9 is an end view in elevation taken substantially from the line 9—9 of FIG. 8.
FIG. 10 is an end view in elevation taken substantially from the lines 10—10 of FIG. 8.
FIG. 15 is a fragmentary view illustrating use of a strap to secure the electrical connections to the system taken substantially along the lines 15—15 of FIG. 2.

Referring to FIGS. 6, 7, 8, 9, and 10, the operation of the quick release coupling mechanism 34 and the associated electrical connector assembly 70 is illustrated. FIG. 6 illustrates the quick release coupling mechanism 34 and the electrical connector assembly 70 in an engaged position with FIG. 7 showing this engaged configuration in cross section. FIG. 8 shows the components of the electrical connector assembly 70 in a disengaged condition with FIGS. 9 and 10 being end views of the elements of the quick release coupling mechanism 34 and the electrical connector assembly 70.

The quick release coupling mechanism 34, which puts the first section 22 of the oxygen delivery hose assembly 20 in communication with the second section 26 thereof, includes a male connector 152 and a female connector 154. A portion 156 of the male connector 152 is provided for insertion in a cavity 158 formed by the female connector 154. The male connector 152 includes a ball type check valve 160 having a valve seat 162 against which a ball 164 is urged by a compression spring 166. When the male and female connectors 152 and 154 are disengaged as illustrated in FIG. 8, the ball 164 rests against the valve seat 162 precluding passage of oxygen through the male connector 152.

The female connector 154 provides a hollow extensive element 168 having a plurality of apertures 170 opening through the tip thereof, the extensive element 168 being positioned within the cavity 158 such that when the portion 156 of the male connector 152 is inserted within the cavity 158, the extensive element 168 enters an aperture 172 disposed through the end of the portion 156. The tip 174 of the extensive element 168 therefore contacts the ball 164 moving it away from the valve seat 162. This results in communication between the sections 22 and 26 of the oxygen delivery hose assembly 70 as illustrated in FIG. 7. When the male connector 152 is withdrawn from the female connector 154, the extensive element 168 of the female connector 154 is withdrawn from the aperture 172 disposed in the portion 156 of the male connector 152 and the ball 164, as urged by the compression spring 166, is repositioned against the valve seat 162 sealing off the section 26 of the oxygen delivery hose 20 to preclude leakage of oxygen therefrom. A reciprocating element 176, urged by a spring 178, is provided and contacts the portion 156 of the male connector 152 when it is inserted within the cavity 158. The reciprocating element 176 shields the locking means 177 in the form of balls or elements 179 until insertion of the male connector 152. When insertion of male connector 152 is made reciprocating element 176 is depressed allowing the balls 179 to engage or enter the annular groove or slot 181 on the male connector 152. The movement of element 176 in the direction of arrow 183 permits each ball 179, one being illustrated, to move downwardly against the seat 185 that is provided adjacent the cavity 158. In the position illustrated in FIG. 8 the balls 179 abut against the shoulder 187 and the outer face 189 of element 176.

Upon movement of the element 176 into the position in FIG. 7 the balls 179 drop into the groove 181 and disengage from their engagement against the shoulder 187. This permits lock ring 180, due to the force applied by spring 191 to automatically force the lock ring 180 into the position illustrated in FIG. 7 by movement in the direction of arrow 193.

Upon manual release of the lock ring 180 to a retracted position, the locking balls 179 are allowed to enter the recess 195 of the lock ring 180 to permit disengagement of balls 179 from groove 181 on the male connector 152. Spring 178 always applies positive pressure to the reciprocating element 176. Accordingly in FIG. 7 the assembled position of connectors 152 and 154 are illustrated. To disengage the connectors 152 and 154 locking ring 180 is first manually retracted such that the recess 195 is above the ball 179. As connector 152 is moved rearwardly relative to connector 154 the inclined surface 197 of groove 181 forces the balls 179 into the recess 195. As this occurs the surface 189 moves forward and beneath the balls 179 to the position illustrated in FIG. 8.

An O-ring 182 is mounted in the aperture 172 of the male connector 152 to enhance the sealing between the interior walls of the aperture 172 and the extensive element 168.

The connectors 152 and 154 are coded by a pair of pins 184 provided on the male connector 152 and a pair of complementary apertures disposed in the female connector 154. When the present invention is used with an OBOGS by convention, two pins 184 are provided and engage the two complementary apertures 186 as illustrated. When the present invention is used in a LOX system, only one pin is provided. This permits a LOX system aircraft to receive a pilot with an OBOGS assembly. The two pin interface prevents one-way interchangeability.

Fixedly secured, respectively, to the male connector 152 and the female connector 154 are the electrical connectors 74 and 72 of the electrical connector assembly 70. The electrical connector 72 provides a plurality of contact pins 188 which are aligned with a plurality of hollow electrical contacts 190. When the male and female connectors 152 and 154 are joined together, the contact pins 188 are pushed into hollow electrical contacts 190 and, since the segment 60 of the electrical cabling 38 is connected to the pins 188 and the segment 62 of the electrical cabling 38 is connected to the hollow electrical contacts 190, electrical continuity in the electrical cabling 38 is provided. The electrical connectors 72 and 74 can be variously configured as desired.

The present invention also permits the removal of the electrical cabling 38 in order to repair or modify certain portions thereof. As illustrated in FIG. 15 the strap 78 has an opening 79 to receive therethrough a portion, such as first segment 60, of the electrical cabling 38. In addition the strap 78 includes a pair of resilient arms 81 to clip onto the section 22.

The electrical connectors 72 and 74 are removable and have an upper section 75 and a lower section 77 that are secured together by retaining screws 83. In this manner, by removal of the screws 83 and straps 76 and 78 the complete wiring of the electrical means 38 may be removed for modification or other reason.

Figure 11:
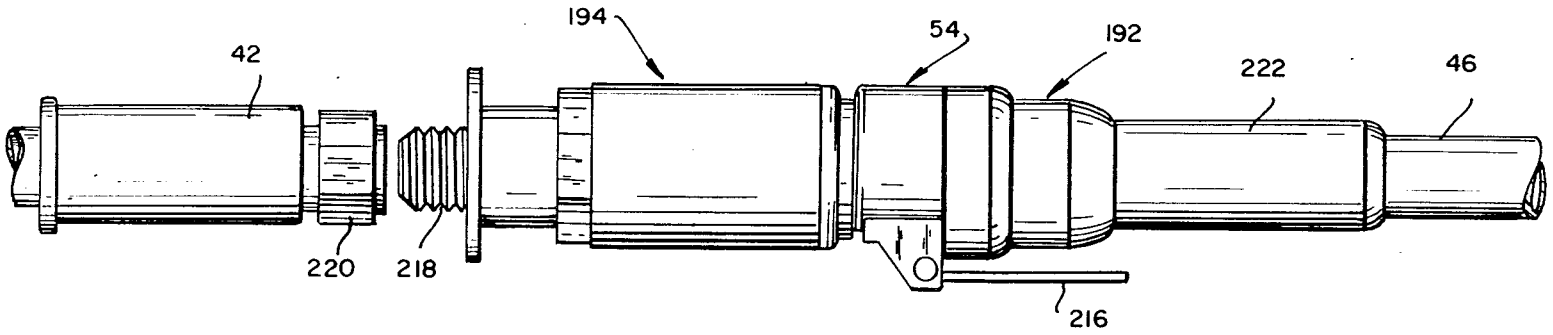
FIG. 11 is a plan view of a breakaway release connection of the present invention in an assembled position.
Figure 12:
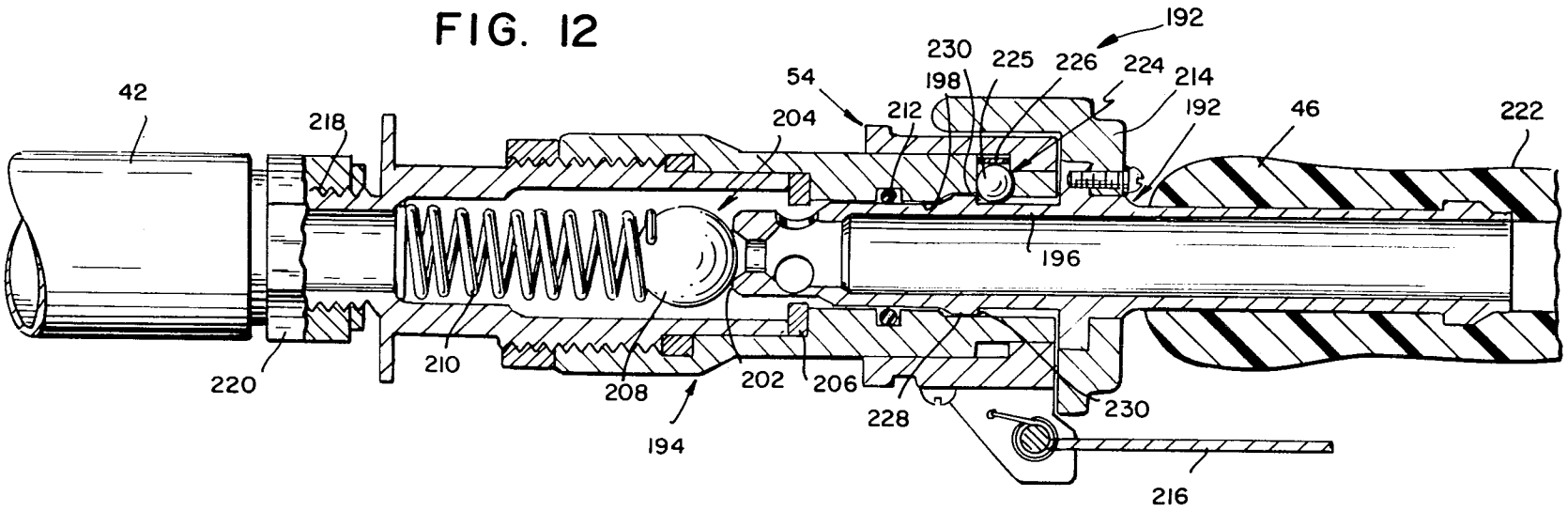
FIG. 12 is an enlarged cross sectional view of the breakaway release connection of FIG. 11 in an engaged position.
Figure 13:
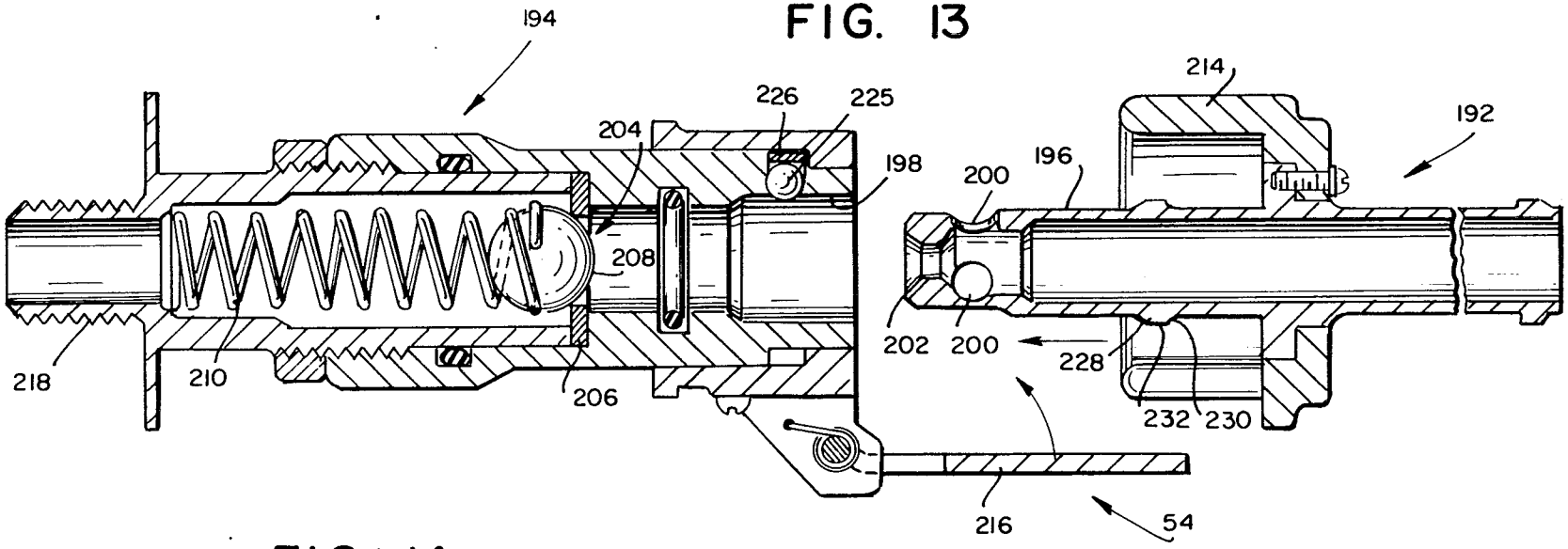
FIG. 13 is an enlarged cross sectional view of the breakaway release connection of FIGS. 11 and 12 in a disengaged condition.

Referring now to FIGS. 11 through 13, the structure of the quick or breakaway release coupling mechanism 54 can be examined. The breakaway release mechanism 54 permits communication between the section 42 of the oxygen supply hose assembly 40 and the section 46 of the oxygen supply and hose assembly 40. FIG. 11 illustrates the breakaway release coupling mechanism 54 such that the elements thereof are engaged, FIG. 12 illustrating the same coupling in cross-section, with FIG. 13 showing the elements of the quick release coupling mechanism 54 in a disengaged condition.

The breakaway release coupling mechanism 54 includes a male connector 192 and a female connector 194. The male connector 192 includes a portion 196 for insertion in a cavity 198 formed in the female connector 194. The interior of the male connector is in communication with a plurality of apertures disposed in the end 202 of the portion 196. The female connector 194 includes a check valve 204 having a valve seat 206 and a reciprocating ball 203 which mates therewith. The ball is urged into position against the valve seat 206 by a helical compression spring 210. When the portion 196 of the male connector 192 is inserted into the cavity 198 formed by the female connector 194, the end 202 of the portion 196 pushes the ball 208 of the check valve 204 away from the valve seat 206 permitting communication between the sections 42 and 46 of the oxygen supply hose assembly 40, as illustrated in FIG. 12.

When the portion 196 of the male connector 192 is withdrawn from the cavity 198 of the female connector 194, the spring 210 pushes the ball 208 into engagement with the valve seat 206 as illustrated in FIG. 13 thereby sealing off the first section 42 of the oxygen supply hose assembly and therefore the primary oxygen supply of the aircraft. To enhance sealing between the portion 196 of the male connector 192, which is inserted in the cavity 198 of the female connector 194, an O-ring 212 is provided in the walls of the cavity 198. A locking flange 214 is provided by the male connector 192 and mates in a conventional manner with complementary structure provided by the female connector 194. A spring urged door 216 is provided on the female connector 194 to cover the opening of the cavity 198 when the male connector 192 is not engaged therewith.

To provide an automatic breakaway at a preselected pressure, for example 20 psi, there is provided a retaining device 224 including a plurality of balls or elements 225 one being illustrated, contained in female connector 194 and extending circumferentially and partially into aperture 198. The balls 225 are kept in position and forced down by a flat spring 226. The spring 226 is calculated to apply a defined amount of downward force.

The male connector 192 has a lip 228 and a shoulder 230. In the assembled position illustrated in FIG. 12 the balls 225 abut against the shoulder 230 preventing disengagement. The disengagement will occur when the force exceeds 20 lbs and the shoulder 230 forces the balls 225 to deflect the spring 226 permitting the rim 232 of the shoulder to clear the balls 225.

The female connector 194 includes a threaded end section 218 onto which a conventional connector 220 can be placed, connector 220 being operably mounted on the first section 42 of the oxygen supply hose assembly 40. Alternately, other suitable means for connecting the oxygen supply hose assembly section 42 to the female connector 194 may be employed. The second section 46 of the oxygen supply hose assembly 40 is connected to the male connector 192 by a suitable crimp fitting 222 or the like.

Figure 14:
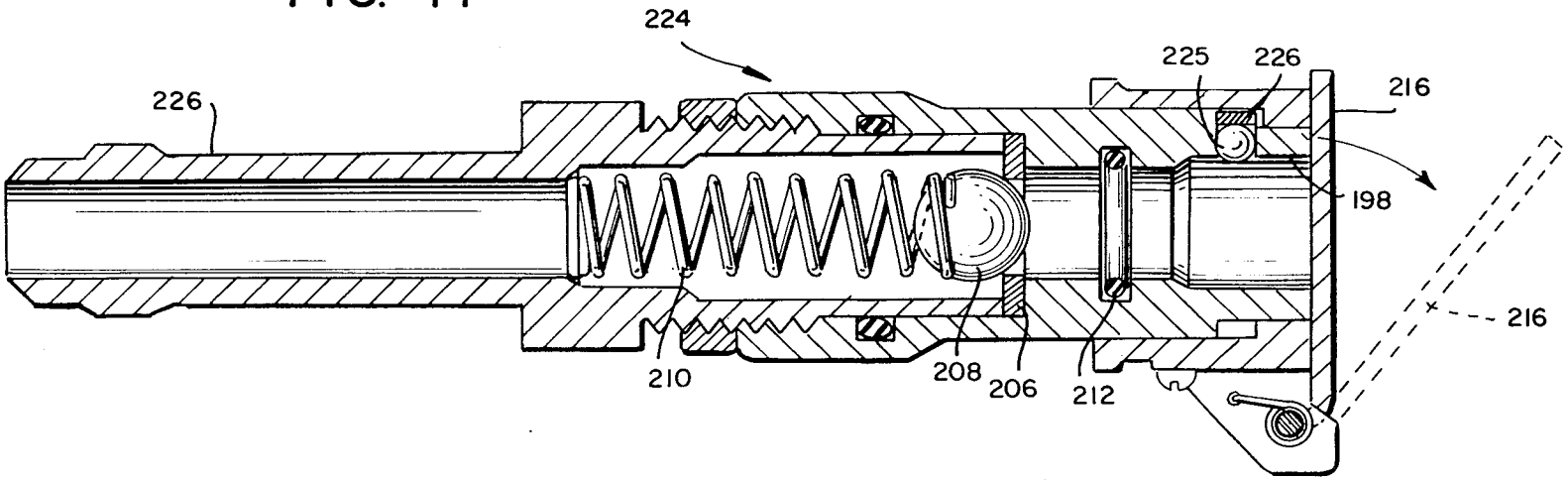
FIG. 14 is an alternate embodiment of one half of the breakaway release connection of FIGS. 11 through 13.

With reference to FIG. 14, an alternate female connector 224 is illustrated. Connector 224 is essentially structurally the same as female connector 194 except that instead of threaded end section 218 an alternate hose mounting portion 226 is provided. Through use of the portion 226 a crimp fitting or the like can be used in place of the threaded connector 220 which engages the threaded end section 218 of the female connector 154. Of course, variations of such connectors here as elsewhere in the invention. is well within the knowledge of one having ordinary skill in the art.

Through employment of the breakaway release coupling mechanisms 34 and 54 oxygen leakage from the ship board supply of oxygen as well as from the differential pressure actuated valve 18 is precluded and no loss of oxygen is experienced when the elements of these connectors are joined together. Therefore, a comprehensive integrated system has been shown which connects together a primary oxygen supply and an emergency oxygen supply for output to a single oxygen mask wherein the user can shift from the primary supply to the emergency supply without the need to disconnect or reconnect any connectors yet which does permit separation of the components of the system through the release of connectors, as desired.

Additionally, the present invention is compatible with LOX as well as OBOGS primary oxygen supplies. Although the present invention was discussed as delivering oxygen, it is to be understood that this does not necessarily limit the invention to pure oxygen, but that other suitable gaseous formulations which are breathable are also to be included within the scope of the invention.

Although illustrative embodiments of the invention have been described in detail herein with reference to the accompanying drawings, it is to be understood that the invention is not limited to the precise embodiments, that various changes and modifications may be affected therein without departing from the scope or spirit of the invention.

Having thus set forth the nature of the invention, what is claimed is:

1. An emergency oxygen supply system for use on an aircraft having an ejection seat, a primary oxygen supply source, an emergency oxygen supply means, and an oxygen mask disposed on said aircraft for supplying oxygen to aircraft personnel disposed upon said ejection seat through said oxygen mask or the like, upon failure of said primary oxygen supply, said system comprising in combination:

(A) differential pressure activated valve means adapted to be affixed to said ejection seat and having an elongated chamber with two input ports and an output port in communication with said elongated chamber, (i) one of said input ports adapted to be in communication with said primary oxygen supply source and the other of said input ports adapted to be in fluid communication with said emergency oxygen supply means, and said output port adapted to be in communication with said oxygen mask, two of said ports being spaced apart along the longitudinal axis of said chamber, and the third port being disposed on one end of said chamber forming one of said input ports of said differential pressure valve means, said port furthermost from said one end of said chamber forming a longitudinal input port of said differential pressure valve means, the remaining port forming the output port of said differential pressure valve means, (ii) a valve shuttle disposed in said elongated chamber dimensioned to freely reciprocate from a first position wherein said valve shuttle permits communication only between said longitudinal input port and said output port and a second position wherein said valve shuttle permits fluid communication only between said input port and said output port, said valve shuttle being an elongated hollow cylinder having an open end and a closed end and having at least one through aperture disposed in said cylinder wall, said valve shuttle being disposed within said elongated chamber formed by said housing such that said open end of said valve shuttle is oriented toward said end input port, said cylinder having an O-ring washer fitted thereon proximate said closed end forming a valve poppet, and said walls of said longitudinal chamber dimensioned to permit free movement of said shuttle between said first and said second positions such that when said shuttle is in said first position said poppet seals said chamber for fluid communication only between said longitudinal input port and said output port, said walls of said longitudinal chamber further forming a complementary valve seat circumferentially disposed between said input port and said output port isolating said longitudinal input port from said output port such that disposition of said valve shuttle in said second position causes said valve poppet to seat on said valve seat so that said end input port is in fluid communication only with said output port through said at least one through aperture disposed in said valve shuttle wall; and (iii) biasing means for biasing said valve shuttle in said first position whereby a first condition is provided wherein only the oxygen from said primary oxygen supply source is provided to said oxygen mask unless the pressure at said input port exceeds the pressure of said longitudinal input port by a predetermined value greater than the force of said biasing means whereby a second condition is provided in which only the oxygen from said emergency oxygen supply means is provided through a completed emergency fluid flow path to said oxygen mask, said differential pressure activated means changing from said first condition to said second condition by a change in the pressure differential between said valve input ports;

(B) means defining a primary fluid flow path having one end connected to said longitudinal input port of said differential pressure activated valve means and an opposite end adapted to be connected to said primary oxygen supply source, a quick disconnect means disposed within said primary fluid flow path and including check valve means for blocking the oxygen flow in said primary fluid flow path from said primary oxygen source when disconnected;

(C) emergency oxygen supply means having a pressure greater than said primary oxygen supply source adapted to be affixed on said ejection seat and in communication with the other of said input ports of said differential pressure activated valve means providing said emergency fluid flow path therebetween; and (D) oxygen release valve means adapted to be affixed to said ejection seat provided with cooperating actuation means adapted to be connected to said aircraft and manual actuation means for manually activating said release valve means and disposed in said emergency fluid flow path, said oxygen release valve means permitting oxygen to flow in said emergency fluid flow path to the other of said input ports of said differential pressure activated valve means when manually activated and when said ejection seat is activated.

2. The system as defined in claim 1, further comprising means for manually activating said oxygen release valve means.

3. The system as defined in claim 1, further comprising means for automatically activating said oxygen release valve means upon ejection of said aircraft personnel from said aircraft.

4. The system as defined in claim 3, further comprising means for manually activating said oxygen release valve means.

5. The system as defined in claim 4, wherein said manual activating means and said automatic activating means each include an activation cable having one end thereof operably connected to said oxygen release valve means such that manual activation occurs by pulling on the other end of said manual activation cable and automatic activation of said oxygen release valve means occurs when said ejection seat is activated, the other end of said automatic activation cable being affixed to said aircraft.

6. The system as defined in claim 5, wherein said manual cable other end includes a pull ring accessibly mounted adjacent to said personnel ejection seat in said aircraft.

7. The system as defined in claim 1, wherein said emergency oxygen supply means is affixed to said ejection seat.

8. The system as defined in claim 1, wherein said biasing means comprises a helical compression spring disposed in said longitudinal chamber, one end of said spring engaging said closed end of said valve shuttle proximate said poppet, the other end of said spring engaging the end of said longitudinal chamber proximate said valve seat.

9. The system as defined in claim 1, wherein said primary fluid flow path includes a mask hose assembly having quick disconnect means, one end of said quick disconnect means being affixed to an ejection seat, the other end of said quick disconnect means being affixed to said oxygen mask.

10. The system as defined in claim 9, wherein said mask quick disconnect means comprises check valve means for sealing off the section of said fluid flow path connected to said differential pressure activated valve means when the portion of said mask hose is separated therefrom by disconnecting of said mask quick disconnect means.

11. The system as defined in claim 10, wherein said mask quick disconnect means includes a cooperating male and female connector and said check valve means comprises a ball valve operably mounted in said male connector, said male connector being closed off thereby when said male connector is disengaged from the female connector, said female connector being provided with an element means which pushes against a portion of said ball valve for opening same when said portion of said male connector is inserted into said female connector.

12. The system as defined in claim 11, further comprising means for locking said male connector to said female connector.

13. The system as defined in claim 12, wherein said locking means comprises:

(A) a circumferentially disposed groove on said male connector;

(B) a plurality of balls on said female connector adapted to extend within said groove to prevent separation of said connectors;

(C) a reciprocating element disposed on said female connector having an outer face with a spring normally maintaining said outer face beneath said balls, said reciprocating element being retracted upon insertion of said male connector with said balls extending with said groove; and (D) a reciprocating sleeve element circumferentially disposed about the outer circumference of said plurality of balls with a spring normally urging said sleeve element to apply inwardly directed forces upon said plurality of said balls in a first position and relieving said forces and permitting said plurality of balls to move outwardly in a second position.

14. The system as defined in claim 13, wherein said reciprocating sleeve element incudes a recess therein for receiving said plurality of balls when said male and female connectors are disengaged from each other and prventing disengagement when said recess extends beyond said balls, such that movement of said sleeve element to said second position is required before disengagement of said connectors can be obtained.

15. The system as defined in claim 11, further comprising means for coding said male and female connectors, said coding means for permitting the engagement of said male and female connectors with each other and other selected types and precluding the engagement of said male and female connectors with other connectors of a non-selected types.

16. The system as defined in claim 15, wherein said coding means comprises at least one pin fixedly secured to one of said connectors, the other of said connectors having at least one complementary aperture disposed therein for accepting said pin.

17. The system as defined in claim 1, wherein said primary fluid flow path includes a primary oxygen supply hose assembly disposed between said primary oxygen supply and said differential pressure activated valve means having a quick disconnect means.

18. The system as defined in claim 17, wherein said primary quick disconnect means comprises check valve means for sealing off the portion of said primary oxygen supply hose connected to said primary oxygen supply when the portion of said hose connected to said differential pressure activated valve means is separated therefrom by disconnecting said quick disconnect means.

19. The system as defined in claim 18, wherein said quick disconnect means includes a cooperating male and female connector and said check valve means comprises a ball valve operably mounted in said female connector, said female connector being connected to said portion of said hose connected to said primary oxygen supply source, said female connector being closed off by said ball valve when said female connector is disengaged from said male connector, said male connector including structure which pushes against a portion of said ball valve and opening same when said portion of said male connector is inserted into said female connector.

20. The system as defined in claim 19, further comprising means for locking said male connector to said female connector.

21. The system as defined in claim 20, wherein said locking means comprises a shoulder on said male connector with balls extending on one side of said shoulder, said balls being resiliently forced against said male connector, such that said male connector can breakaway from said female connector upon a predetermined longitudinal force being placed thereon.

22. The system as defined in claim 19, further comprising cover means for covering said portion of said female connector into which said male connector is inserted when said male connector is disengaged therefrom.

23. The system as defined in claim 1, wherein said oxygen mask has associated therewith electrical apparatus requiring electrical connection to cooperating electrical apparatus associated with said aircraft, said system further comprising electrical connection means for interconnecting said electrical apparatuses.

24. The system as defined in claim 23, wherein said electrical connection means comprises an electrical cable, said electrical cable being divided into a first segment electrically connected on one end thereof to said electrical apparatus associated with said oxygen mask and a second segment being electrically connected on one end thereof to said cooperating electrical apparatus associated with said aircraft, said electrical connector means further comprising a pair of complementary electrical connectors, one of said connectors being affixed to the ejection seat of said aircraft personnel and the other of said electrical connectors being affixed to said aircraft, said pair of electrical connectors electrically interconnecting the other ends of the first and second segments of said electrical cable.

25. The system as defined in claim 24, wherein one of said pair of electrical connectors is fixedly secured to one of said pair of mating connectors of said quick disconnect means, the other of said pair of electrical connectors being fixedly secured to the other of said pair of mating connectors of said quick disconnect means, engagement of said pair of mating connectors of said quick disconnect means causing essentially simultaneous engagement of said pair of mating connectors of said quick disconnect means causing essentially simultaneous disengagement of said pair of electrical connectors.

26. The system as defined in claim 25, further comprising an additional electrical connector for connecting said one end of said second segment of said electrical cable to said cooperating electrical apparatus associated with said aircraft.

* * * * *

UNITED STATES PATENT AND TRADEMARK OFFICE

CERTIFICATE OF CORRECTION

PATENT NO. : 4,619,255

DATED : October 28, 1986

INVENTOR(S) : Spinosa et al.

It is certified that error appears in the above-identified patent and that said Letters Patent is hereby corrected as shown below:

Column 15, line 12, "prventing" should read
-- preventing --.

Signed and Sealed this

Sixth Day of January, 1987

*Attest:*

DONALD J. QUIGG

*Attesting Officer*

*Commissioner of Patents and Trademarks*